United States Patent [19]

Fletcher

[11] Patent Number: 4,643,399

[45] Date of Patent: Feb. 17, 1987

[54] APPARATUS FOR COUNTERBALANCING TONGS

[76] Inventor: Stanley Fletcher, 100 Swan Cir., Lafayette, La. 70508

[21] Appl. No.: 733,717

[22] Filed: May 13, 1985

Related U.S. Application Data

[63] Continuation-in-part of Ser. No. 379,276, May 17, 1982, abandoned.

[51] Int. Cl.[4] ..... B66F 3/24

[52] U.S. Cl. ..... 254/386; 254/392

[58] Field of Search ..... 254/386, 385, 335, 336, 254/273, 392

[56] References Cited

U.S. PATENT DOCUMENTS

| | | | |
|---|---|---|---|
| 189,424 | 4/1877 | Brewer | 254/386 |
| 209,336 | 10/1878 | Fensom | 254/386 |
| 3,799,009 | 3/1974 | Guier | 414/22 |
| 4,023,449 | 5/1977 | Boyadjieff | 81/57.34 |

FOREIGN PATENT DOCUMENTS

| | | | |
|---|---|---|---|
| 2949581 | 6/1981 | Fed. Rep. of Germany | 254/386 |
| 10569 | 5/1912 | United Kingdom | 254/336 |
| 268018 | 3/1927 | United Kingdom | 254/386 |

*Primary Examiner*—Stuart S. Levy
*Assistant Examiner*—Katherine Matecki
*Attorney, Agent, or Firm*—Keaty & Keaty

[57] ABSTRACT

An apparatus for balancing tongs is comprised of a pair of fluid actuated piston and cylinder assemblies. The rod of each assembly carries a first pair of rotatably mounted pulley wheels, and a second pair of pulley wheels is mounted on the assembly in spaced relationship to the first set of pulley wheels. A cable is journalled around the pulley wheels, suspended over an elevated pulley and attached to a hydraulic tong for counterbalancing, lifting and lowering the tong. A bleed line permits fluid to escape from the cylinder as the hydraulic tong moves downwardly with a workpiece.

9 Claims, 10 Drawing Figures

APPARATUS FOR COUNTERBALANCING TONGS

This is a continuation in part of my U.S. patent application Ser. No. 379,276, filed May 17, 1982, now abandoned, the disclosure of which is incorporated by reference.

BACKGROUND OF THE INVENTION

1. Field of the Invention

This invention concerns an apparatus for counterbalancing tongs in an oil derrick as well as assisting in lowering and raising the tongs to position them around a workpiece.

2. General Discussion of the Background

The general background of the present invention is discussed in greater detail in my prior copending application Ser. No. 379,276 filed May 17, 1982 which has been incorporated by reference.

In the oil exploration and production industry, it is common to use a pair of tongs to assemble such things as drill strings. The drill strings are provided with internally and externally threaded ends which mate in threaded engagement with adjacent segments to assemble successive segments of pipe. The successive segments must be rotated in order to engage the threads on successive segments.

Rotation of the segments of pipe is performed by a tong which is a jaw-like member defining a semicircular recess in which a plurality of high coefficient of friction rolling members are located. The tong is positioned adjacent the pipe, the roller is placed in frictional engagement with it, and the rollers are then hydraulically actuated in a manner known in the art to rotate the section of pipe. A pair of such tongs are often used in assembling successive sections of the pipe. The second tong, however, only performs a supporting function without necessarily actively rotating the pipe.

In order to use tongs, it is necessary to hold them in position next to the workpiece being rotated so that the rollers of the tong can engage the work piece and rotate it. In the prior art, these tongs have been suspended by a cable which is attached at one end to the tong and at its second end to a counterweight, the cable being journalled over an elevated pulley. A counterweight is usually of an appropriate weight that will suspend the tong at a desired height while permitting a worker to make adjustments in the height of the tong without exerting himself too greatly. There are serious drawbacks to the tong counterbalances, however, because these counterbalances do not permit fine movement adjustments of the tongs in relation to the workpiece. Another drawback is that the counterbalanced tongs are subject to destabilizing forces that can quickly and dangerously raise or lower the tong, thereby injuring any workmen in the vicinity.

It is accordingly an object of this invention to provide an apparatus for counterbalancing tongs and assisting in lowering and raising the tongs within an oil derrick.

It is another object of the invention to provide such an apparatus that will permit fine movement adjustments of the height of the tongs.

Yet another object of the invention is to provide such an apparatus in which the height of the tongs is under positive control by workmen at all times.

SUMMARY OF THE INVENTION

The aforementioned objects are achieved by providing an apparatus for counterbalancing tongs and assisting in lowering and raising the tongs within an oil derrick. The apparatus is comprised of a fluid actuated piston and cylinder assembly for each tong. A bracket is carried by the piston of each assembly, and a first pair of pulley wheels is coaxially rotatably carried by each bracket. A second pair of pulley wheels is coaxially rotatably mounted in spaced relationship to the first pair of pulley wheels. A cable is journalled alternately around the first and second sets of pulley wheels, and a free end of the cable is fixed to a tong to counterbalance the tongs and permit fine, positively controlled movements thereof. A switch is provided on the drive tong for controlling the movement of fluid into or out of the fluid actuated hydraulic piston and cylinder assembly that controls the height of the drive tong.

A bleed line establishes fluid communication between the fluid actuated assembly for the drive tong and a bleed tank container. The container is divided by a fluid impermeable flexible diaphragm, and the container on one side of the diaphragm is pressurized while the container on the other side of the diaphragm is in fluid communication with the assembly through the bleed line. When the drive tong attached to the assembly moves downwardly with a workpiece being rotated, the pairs of pulleys move towards each other, thereby compressing the fluid in the piston and cylinder assembly. Once the compressed fluid reaches a preselected pressure, the flexible diaphragm in the container will move. This allows the tong to remain level and also eliminates the possibility of sudden and dangerous movements of the tong.

BRIEF DESCRIPTION OF THE DRAWINGS

A better understanding of the present invention may be had by reference to the following drawings.

DETAILED DESCRIPTION OF THE PREFERRED EMBODIMENT

Figure 1:
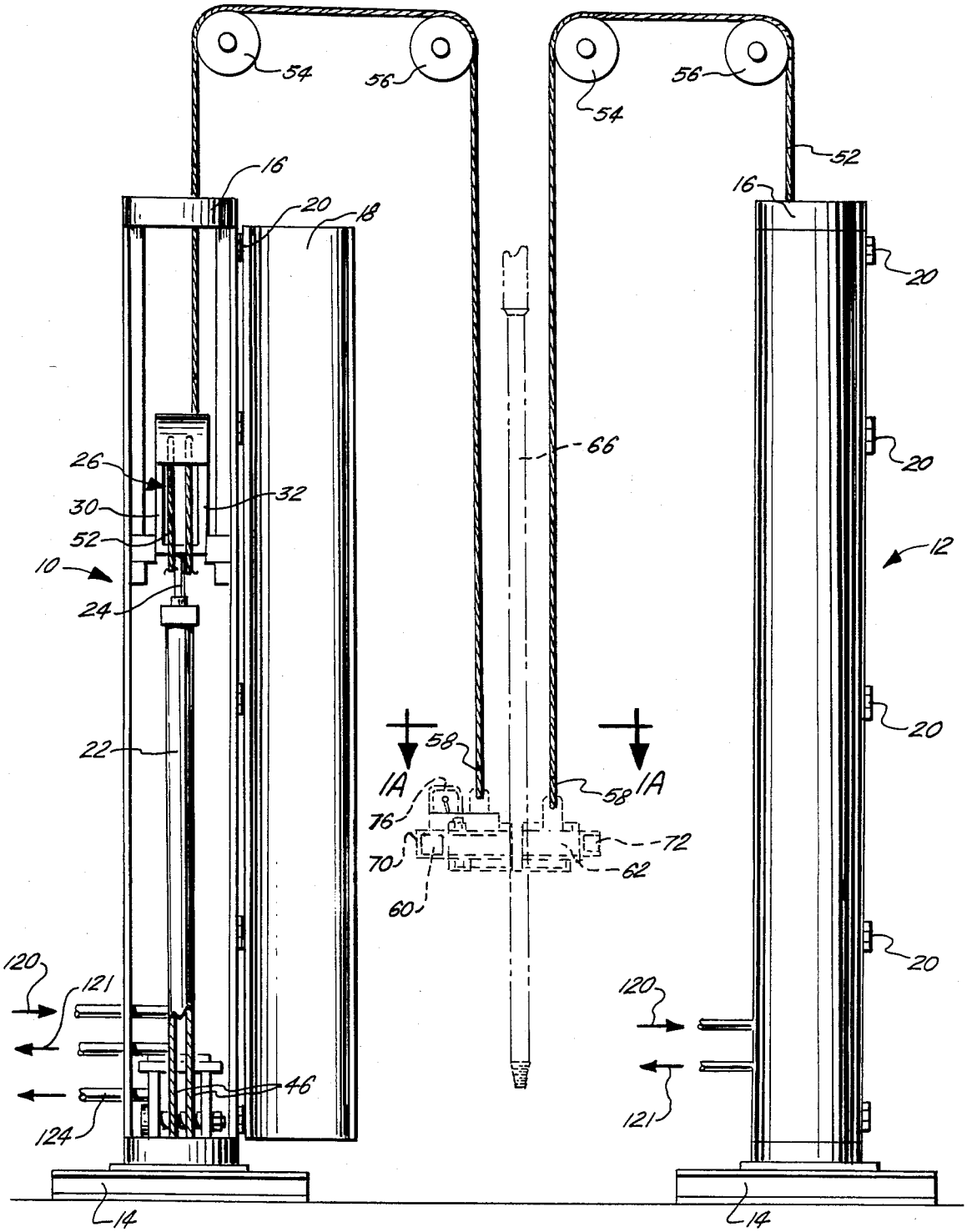
FIG. 1 is a side view of a pair of tongs in engagement around a workpiece, each tong being suspended by a fluid actuated piston and cylinder assembly, portions of the fluid supply lines being shown. An access door of one of the assemblies is open to reveal the interior structure which the door of the other assembly is closed as it would be during normal operation.

The following detailed description of the preferred embodiment is being given in accordance with requirements of law which require that the best mode of making and using the invention be disclosed by the inventor. This detailed description is not intended to limit the scope of the invention, which is more appropriately construed in accordance with the appended claims.

An apparatus for counterbalancing tongs and assisting in lowering and raising the tongs within an oil derrick is shown in FIGS. 1–8. The apparatus is seen to be comprised of first and second vertically oriented fluid actuated piston and cylinder assemblies 10, 12. Since each of the assemblies 10, 12 is substantially identical, the same reference numerals will be used to refer to their respective parts. Each of the assemblies 10, 12 is mounted on a base 14 which is comprised of a plate that can be secured to the floor of a rig by bolts. A large, cylindrical housing 16 in preferred embodiments has a height of about 20 feet. An arcuate door 18 is attached to housing 16 by hinges 20 so that the door can be selectively moved in and out of closing engagement with an opening in housing 16. Door 18 permits access to the interior of the housing for servicing and repair.

Each assembly 10, 12 is comprised of a cylinder 22 and piston 24. A bracket 26 is carried by each piston 24, and is comprised of a generally U-shaped member with a revolving axle 28 rotatably mounted between the tines 30, 32 of bracket 26.

A first pair of pulley wheels 34 is comprised of first and second pulley wheels coaxially rotatably carried by the axle 28 of each bracket. An extension 36 on each side of bracket 26 forms a pair of slots 38, 40 into which flanges 42, 44 of housing 16 fit in guiding relationship with the slots 38, 40 of extensions 36. The cooperation of flanges 42, 44 and slots 38, 40 helps retain pulleys 34 in a uniform plane by avoiding twisting.

A second pair of pulley wheels 46 is comprised of third and fourth coaxially, rotatably mounted pulley wheels mounted on a horizontal axle 48 carried between a lower bracket 50 mounted between base 14 and the bottom of cylinder 22. Second pair of pulley wheels 46 is in spaced relationship to first pair of pulley wheels 34. Since the first pair of wheels 34 is mounted within bracket 26 carried by piston 24, the upward movement of piston 24 moves the first and second sets of wheels 34, 46 farther apart.

Figure 2:
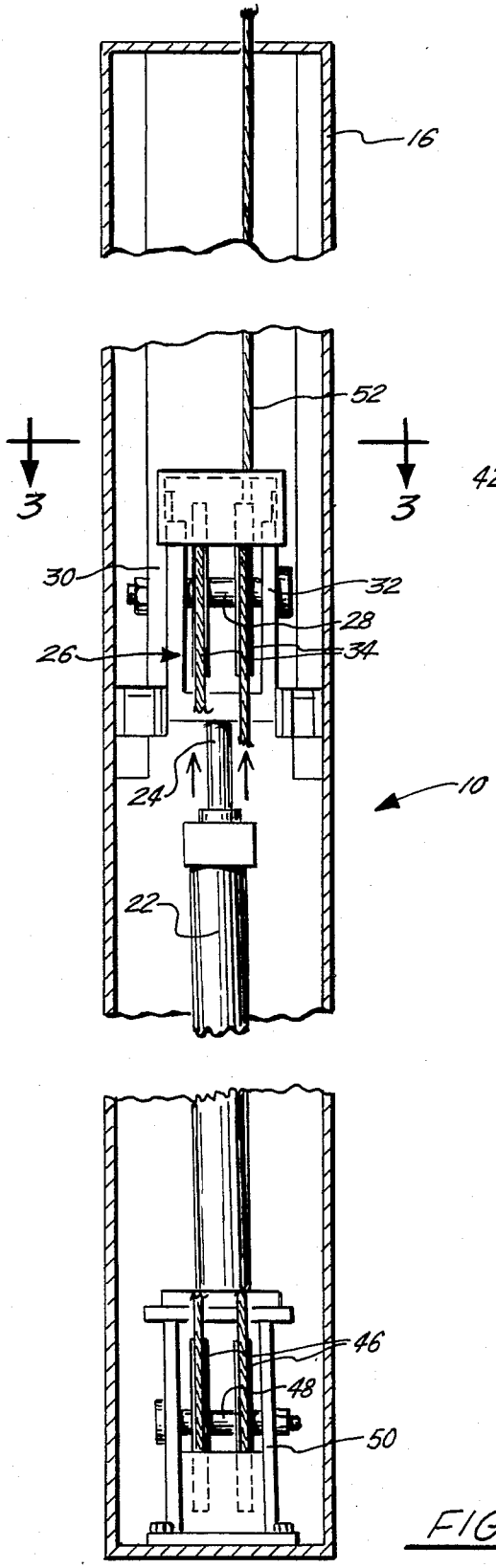
FIG. 2 is an enlarged, fragmentary cross-sectional view of the one of the fluid actuated piston and cylinder assemblies.
Figure 3:
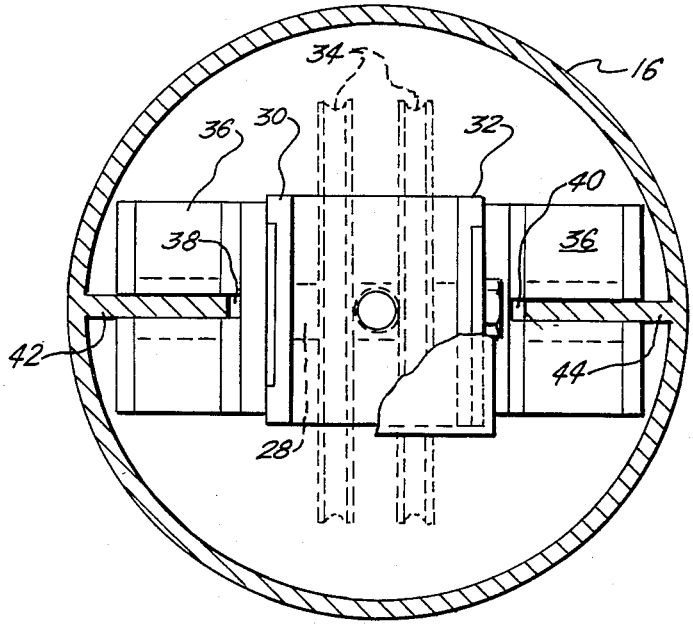
FIG. 3 is a cross-sectional view taken along section lines 3—3 in FIG. 2.

A cable 52 is journalled alternately around the first and second sets of pulley wheels 34, 46 in each of assemblies 10, 12. Referring in more detail to FIG. 2, cable 52 is first attached to lower bracket 50, then journalled over the left hand wheel of first pair 34, down and around the left hand wheel of pair 46, up, over and around the right hand wheel of pair 34, down, under and around the right hand wheel of lower pair 46, and thence upwardly and out of the open top of hollow, cylindrical assembly 10. After exiting the assembly, the cable is placed over elevated pulleys 54, 56. A free end 58 of each cable 52 is fixed to a tong for counterbalancing and permitting fine movements of the tong. The cable of first assembly 10 is connected to and counterbalances a drive tong 60. The cable of second assembly 12 is connected to and counterbalances a support tong 62.

Figure 1A:
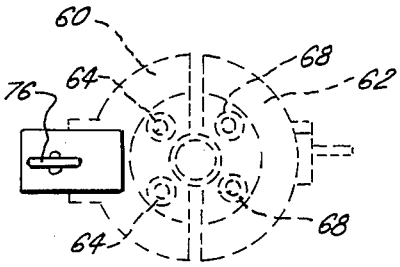
FIG. 1A is a cross-sectional view taken along section line 1A—1A of FIG. 1.

The tongs 60, 62 can be better understood by reference to FIG. 1A. Tong 60 is provided with vertically oriented drive rollers 64 which can be actuated by means well known in the art to rotate a workpiece 66. Support tong 62 is provided with support rollers 68 that help maintain workpiece 66 in an essentially vertical position in frictional engagement with drive rollers 64 while the workpiece is rotating. Tongs 60, 62 are further provided with handles 70, 72 respectively for aiding manipulation of the tongs.

A source of fluid 74 (FIGS. 6 and 9) is provided of reciprocally moving the piston 24 of first and second assemblies 10, 12 to lift tongs 60, 62 respectively as the sets of pulleys 34, 46 move away from each other and lower the tongs as the sets of pulleys 34, 46 move towards each other. A switch 76 (FIGS. 1, 1A, 7, 8 and 9) is mounted on drive tong 60 for controlling movement of fluid between source 74 and the assembly 10. A container 78 (FIGS. 6 and 9) is divided by a fluid impermeable flexible diaphragm 80, the container 78 on a first side 82 of diaphragm 80 being pressurized to preferably about 500 psi by gas such as air or nitrogen. The container 78 on a second side 84 of diaphragm 80 is in fluid communication with cylinder 22 of first assembly 10 through a bleed line 86.

Figure 6:
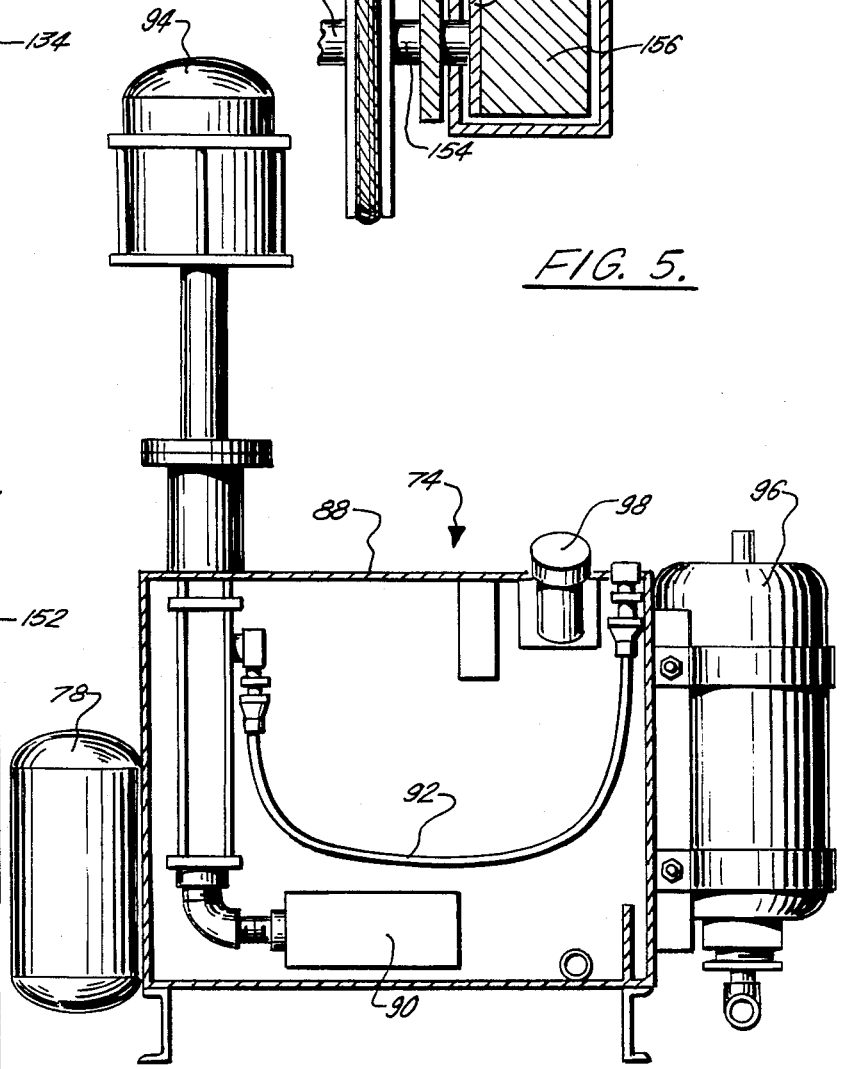
FIG. 6 is a side view, partially in cross section, of a source of fluid supply for the piston and cylinder assemblies.
Figure 7:
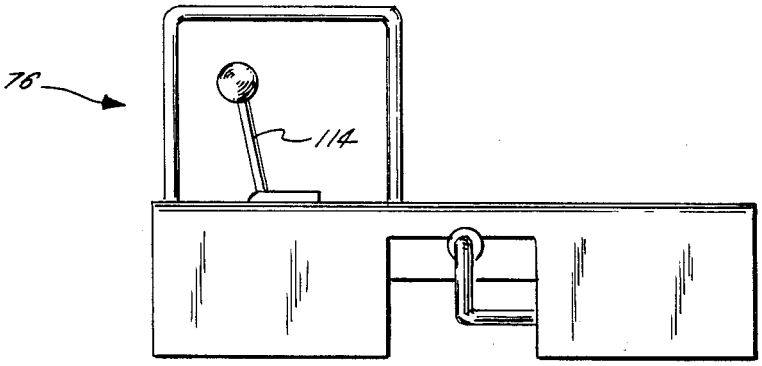
FIG. 7 is an enlarged side view of the switch which is located on the one of the tongs.
Figure 8:
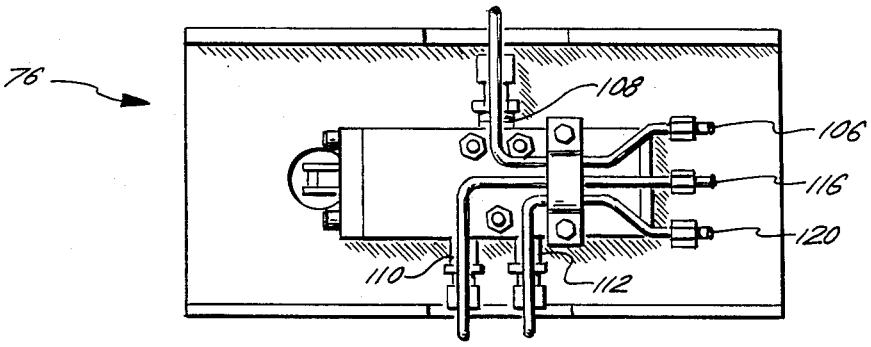
FIG. 8 is a bottom view of the switch shown in FIG. 7.
Figure 9:
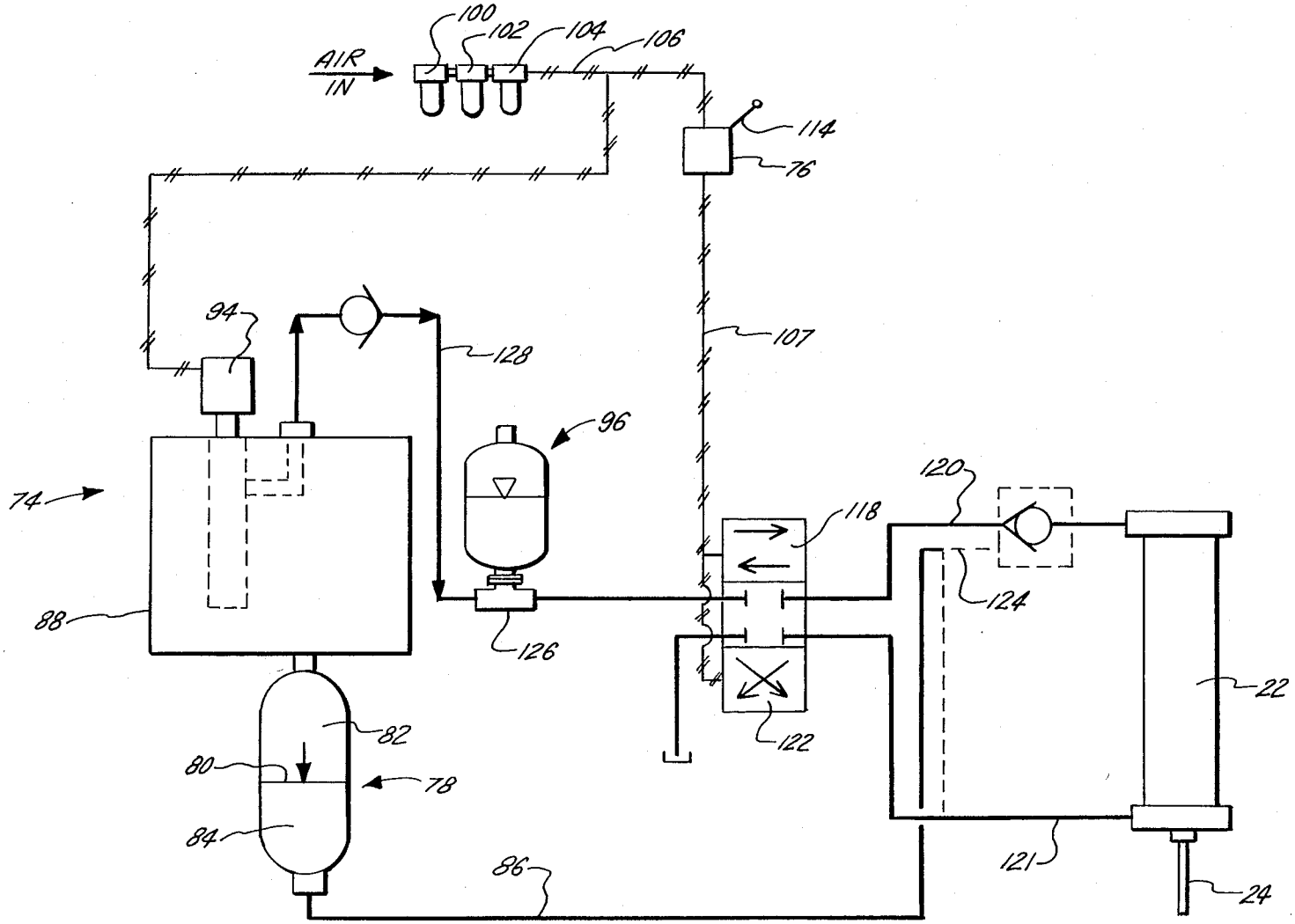
FIG. 9 is a schematic view showing the source of hydraulic fluid for the piston and cylinder assemblies as well as the actuating fluid lines from the switch shown in FIGS. 7 and 8.

Turning now to FIGS. 6 and 9, the system for providing fluid to assemblies 10, 12 is shown in greater detail. Source 74 is seen to be comprised of a fluid container 88 having a screen 90 in the bottom of the tank formed by container 88. Fluid is filtered through screen 90 and into a fluid line 92 by means of an Aro pump 94. Fluid then moves into an accumulator tank 96 where it is precharged to a desired pressure so that the pump does not need to build up any pressure to supply it to the assemblies 10, 12. A container of lubricant 98 introduces lubricant into the fluid to keep the component parts of the system well oiled.

FIG. 9 shows in detail the presence of a pressure regulator 100, water trap 102 and lubricator 104 in an air line which is used as a switch for activating source 74 via switch 76. Air is constantly introduced through line 106 into switch 76 (FIGS. 7 and 8) and pump 94. The interior of switch 76 has a solid member with a plurality of passageways between inlet 108 and outlets 110, 112. Manipulation of lever 114 moves the solid member inside the switch to establish fluid communication alternately between inlet 108 and outlets 110, 112. If fluid communication is established with outlet 110, air moves through line 116 (which connects with line 107) to directional flow valve 118 to thereby activate introduction of fluid from source 74 through line 120 into cylinder 22. Alternately, if fluid communication is established between inlet 108 and outlet 112, air moves through line 120 (which connects with line 107) to activate directional flow valve 122 which lowers piston 24 back into cylinder 22 in a manner well known in the art by introducing fluid through line 121 and removing it through line 120. In the neutral position of the switch, flow of air to either of outlets 110, 112 is blocked.

As best seen in FIGS. 1 and 2, drive tong 60 engages workpiece 66 while being suspended and counterbalanced by assembly 10. As workpiece 66 is rotated and screwed into an adjoining workpiece, the workpiece 66 and drive tong 60 move downwardly. The downwardly movement exerts tension on cable 52 which tends to move sets of pulleys 34, 46 towards each other and compress piston 24 into cylinder 22. Such compression creates a very harmful condition in which drive tong 60 tends to tilt, moving the switch end higher relative to the drive end of drive tong 60. Creation of this pressure in assembly 10 can also result in dangerous rapid, upward movement of drive tong 60 when this downward pressure is released, such as occurs after rotation of workpiece 66 ceases. To avoid these very dangerous occurrences, a bleed line 86 is provided which connects to outlet 124 on the bottom of cylinder 22.

It will be noted that the bleed line is provided only on first assembly 10 which counterbalances tong 60, this precaution not being necessary in the usual case with regard to tong 62. As pressure builds up within cylinder 22 of assembly 10, this fluid pressure is communicated through 124, 86 to container 78. When the pressure on second side 84 of container 78 becomes greater than the preselected pressure on first side 82, diaphragm 80 moves upwardly to allow the excess pressure to escape from cylinder 22. Sets of pulley wheels 34, 46 will then move closer to each other and allow drive tong 60 to assume a new, lower, level position. This eliminates the wear and other problems experienced when drive tong 60 tilts, and additionally avoids dangerous upward movement of drive tong 60 that can occur once the downward movement of workpiece 66 has halted and it is desired to raise tong 60.

A velocity control valve 126 controls the velocity of fluid moving from tank 96 to cylinder 22 to assure even, controlled movements of piston 24.

Figure 5:
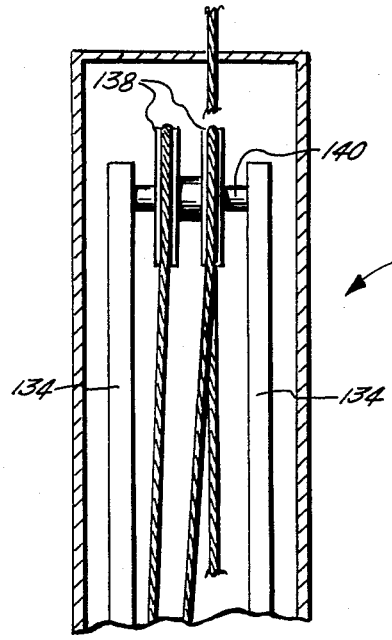
FIG. 5 is an enlarged, cross-sectional view taken along section lines 5—5 of FIG. 4.
Figure 5:
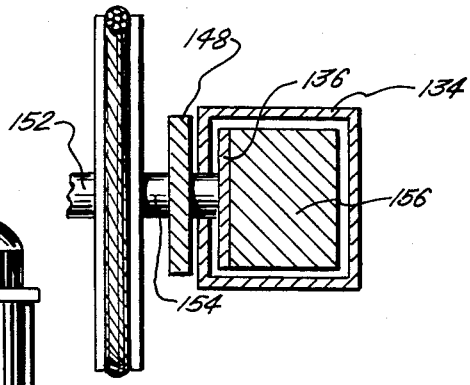
Figure 4:
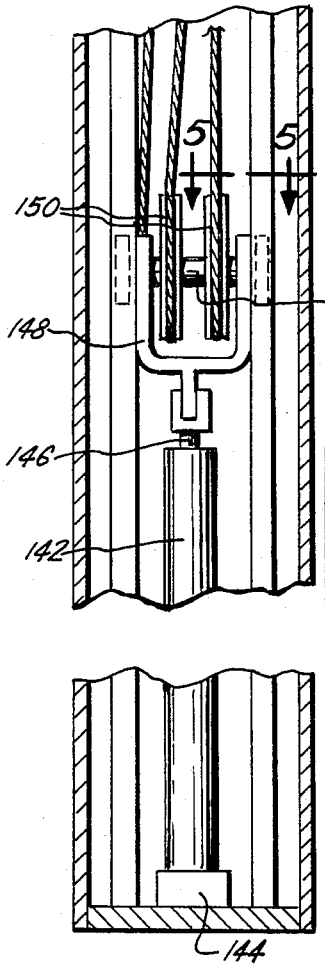
FIG. 4 is an enlarged, cross-sectional view similar to FIG. 2, yet showing a second embodiment of the invention in which the upper pulley is stationary.

An alternate embodiment of the invention is shown in FIGS. 4 and 5 in which an assembly 130 is comprised of a housing 132 similar to the housing 10 described above. Inside housing 132 are a pair of upright guides 134 that form a rectangular enclosure with a slot 136. A stationary set of pulley wheels 138 are fixed on a stationary rotatable axle 140 that is in fixed, rotating engagement between guides 134 adjacent their topmost portions. Cylinder 142 is mounted on the base 144 of assembly 130, and piston 146 moves reciprocally within cylinder 142. A generally U-shaped bracket 148 is carried by piston 146, and a second set of pulley wheels 150 are fixed on a rotating axle 152 which is carried between the tines of bracket 148.

Axle 152 is provided with an extension 154 (FIG. 5) that projects through slot 136 of guides 134. To the end of extension 154 is attached a block 156 which has dimensions substantially equal to the cross sectional dimensions of guides 134. Block 156 in cooperation with slot 136 and bracket 148 ensures that second set of pulleys 150 remain in a uniform plane and do not rotate about an axis through cylinder 142. The embodiment of FIGS. 4 and 5 differs from that shown in the other drawings in that the upper set of wheels 138 is stationary instead of movable.

The operation of both embodiments will be understood by a detailed description of the operation of the embodiment shown in FIG. 1. Drive tong 60 is placed adjacent workpiece 66 at a desired height, and drive wheels 64 are actuated to rotate work piece 66. The support tong 62 is at the same time situated at the same level adjacent drive tongs 60 to hold workpiece 66 in substantially vertical relationship between tongs 60, 62. The height of tongs 60, 62 is controlled by introducing or removing fluid from cylinder 22 of assemblies 10, 12. The height of drive tong 60 can be controlled with the switch 76 on tong 60 by moving lever 114 to establish fluid communication between inlet 108 and outlets 110 or 112. If the lever is moved so as to establish fluid communication with outlet 110, air pressure moves through line 107 to activate directional valve 118 and cause introduction of fluid through line 120 from source 74 into cylinder 22, thereby raising the height of drive tong 60. Alternately, if it desired to lower tong 60, lever 114 is manipulated so as to permit fluid communication between inlet 108 and outlet 112, moving air through a portion of line 107 that communicates with valve 122, thereby switching the valve to allow fluid to leave cylinder 22 through line 120 and enter through line 121. In this manner, the position of drive tong 60 can be positively controlled by a workman using the tongs.

As workpiece 66 is lowered into threaded engagement with an adjacent workpiece, the driving rollers of tong 60 are moved downwardly to tilt tong 60 and exert tension on cable 52. This tension on the cable moves sets of wheels 34, 46 closer to one another and compresses the fluid in cylinder 22. When the force of compression compresses the fluid in cylinder 22 above a desired level, this pressure is communicated through line 124, 86 to container 78. When the built up pressure in cylinder 22 reaches the same pressure as in the container 78 on side 82, diaphragm 80 flexes to permit fluid to move out of cylinder 22 through line 124. Piston 24 is then permitted to move downwardly into cylinder 22 and reestablishes a condition of equilibrium. At the same time, tong 60 will be lowered to a new height which relieves stress on cable 52, permits tong 60 to achieve a horizontal orientation at all times, and avoids the problem of uncontrollable upward movement of tong 60 once rotation of workpiece 66 has ended. Once pressure on the diaphragm is relieved, the fluid will be forced back out of container 78 through line 86, 124 and into cylinder 22.

The foregoing detailed description of the preferred embodiment is not intended to limit the scope of the invention. This scope is more appropriately construed in accordance with the following claims:

I claim:

1. An apparatus for counterbalancing tongs and assisting in lowering and raising the tongs within an oil derrick, comprising:

a fluid actuated piston and cylinder assembly;

a bracket carried by the piston;

a first pair of pulley wheels comprised of first and second pulley wheels coaxially rotatably carried the bracket;

a second pair of pulley wheels comprised of third and fourth coaxially rotatably mounted pulley wheels in spaced relationship to the first pair of pulley wheels;

a cable journalled alternately around the first and second sets of pulley wheels, a free end of the cable being fixed to a first tong to counterbalance and permit fine movements of the first tong;

a source of fluid for reciprocally moving the piston to lift the first tong as the first and second sets of pulleys move away from each other and lower the tongs as the first and second sets of pulleys move towards each other; and a container divided by a fluid impermeable flexible diaphragm, the container on one side of the diaphragm being pressurized, the container on the other side of the diaphragm being in fluid communicating relationship with the piston and cylinder assembly through a bleed line.

2. The apparatus of claim 1 further comprising a switch on the first tong for controlling movement of fluid between the source and the piston and cylinder assembly.

3. The apparatus of claim 1 further comprising a second substantially identical apparatus for counterbalancing a second tong, the second tong cooperating with the first tong.

4. The apparatus of claim 3 wherein a switch is provided on the first tong for controlling movement of fluid between the source and the piston and cylinder assembly.

5. The apparatus of claim 1 wherein the piston and cylinder assembly is vertically oriented, upward movement of the piston moving the first and second sets of pulleys closer together to lower the tongs.

6. The apparatus of claim 1 wherein the piston and cylinder assembly is vertically oriented, upward movement of the piston moving the first and second sets of pulley wheels further apart to raise the tongs.

7. The apparatus of claim 6 wherein the second pair of pulleys is mounted below the cylinder.

8. The apparatus of claim 6 wherein the first set of pulley wheels is guided by a pair of opposing guide flanges in guiding relationship to the first set of pulley wheels on each side of the first set of pulley wheels.

9. An apparatus for counterbalancing hydraulic tongs and assisting in lowering and raising the tongs within an oil derrick, comprising:

first and second vertically oriented fluid actuated piston and cylinder assemblies, each assembly being comprised of:

a bracket carried by the piston;

a first pair of pulley wheels comprised of first and second pulley wheels coaxially rotatably carried by the bracket, a portion of the bracket being received in guiding relationship with a guide flange on each side of the bracket carrying the first set of pulley wheels;

a second pair of pulley wheels comprised of third and fourth coaxially rotatably mounted pulley wheels in spaced relationship to the first pair of pulley wheels, upward movement of the piston moving the first and second sets of pulley wheels farther apart, the second pair of pulley wheels being mounted below the cylinder of the assembly;

a cable journalled alternately around the first and second sets of pulley wheels of the piston and cylinder assembly, a free end of the cable being fixed to a tong for counterbalancing and permitting fine movements of the tong, the cable of the first assembly being connected to and counterbalancing a drive tong and the cable of the second assembly being connected to and counterbalancing a support tong;

a source of fluid for reciprocally moving the piston of the first and second piston and cylinder assemblies to lift the tongs as the first and second sets of pulleys move away from each other and lower the tongs as the first and second sets of pulleys move towards each other;

a switch mounted on the drive tong for controlling movement of fluid between the source and the first piston and cylinder assembly; and a container divided by a fluid impermeable flexible diaphragm, the container on one side of the diaphragm being pressurized, the container on the other side of the diaphragm being in fluid communication with the first piston and cylinder assembly through a bleed line.

* * * * *